United States Patent [19]

Soboul

[11] Patent Number: 4,748,304

[45] Date of Patent: May 31, 1988

[54] ELECTRICAL CIRCUIT BREAKER WITH IMPROVED DIELECTRIC WITHSTAND

[75] Inventor: Raymond Soboul, Autrans, France

[73] Assignee: Merlin Gerin, Grenoble Cedex, France

[21] Appl. No.: 26,390

[22] Filed: Mar. 16, 1987

[30] Foreign Application Priority Data

Mar. 26, 1986 [FR] France ..... 86 04493

[51] Int. Cl.[4] ..... H01H 33/00

[52] U.S. Cl. ..... 200/148 R; 200/146 R

[58] Field of Search ..... 200/50 AA, 144 B, 144 AP, 200/145, 146 R, 148 R, 148 A, 148 B, 148 F, 150 G

[56] References Cited

U.S. PATENT DOCUMENTS

| | | | |
|---|---|---|---|
| 3,671,696 | 6/1972 | Brunner | 200/144 B |
| 3,727,109 | 4/1973 | Kozlovic | 200/148 R X |
| 4,594,488 | 6/1986 | Talpo | 200/148 A X |

FOREIGN PATENT DOCUMENTS

| | | |
|---|---|---|
| 0011542 | 5/1980 | European Pat. Off. . |
| 1815718 | 7/1970 | Fed. Rep. of Germany . |

*Primary Examiner*—J. R. Scott

*Attorney, Agent, or Firm*—Parkhurst & Oliff

[57] ABSTRACT

A puffer-type electrical circuit breaker is insulated by an SF6 insulating gas contained in a casing of moulded insulating material. The circuit breaker comprises a system of contacts, a pair of connection terminals electrically connected to the contacts by means of bushings passing through the wall of the casing in a perpendicular direction to the longitudinal axis, and means of fixing the casing to a metal support at ground or earth potential. The external lateral surface of the insulating casing comprises a plurality of longitudinal flanges designed to increase the creepage distance between the terminals and the support. The creepage distance value is greater than the distance in the air between the same parts.

9 Claims, 4 Drawing Sheets

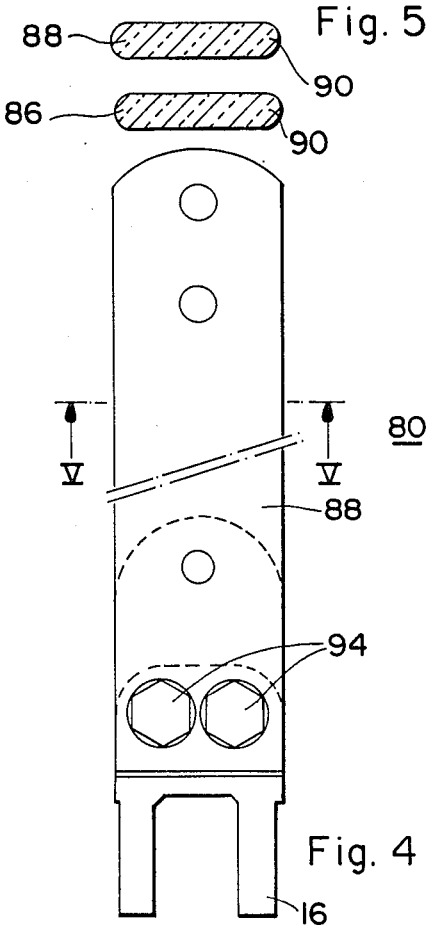
Fig. 5
Fig. 4
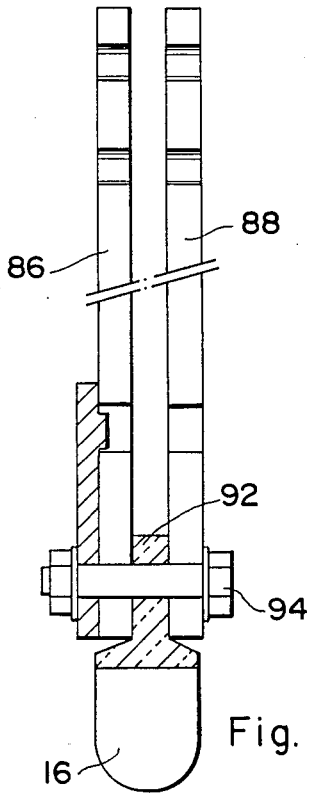
Fig. 3
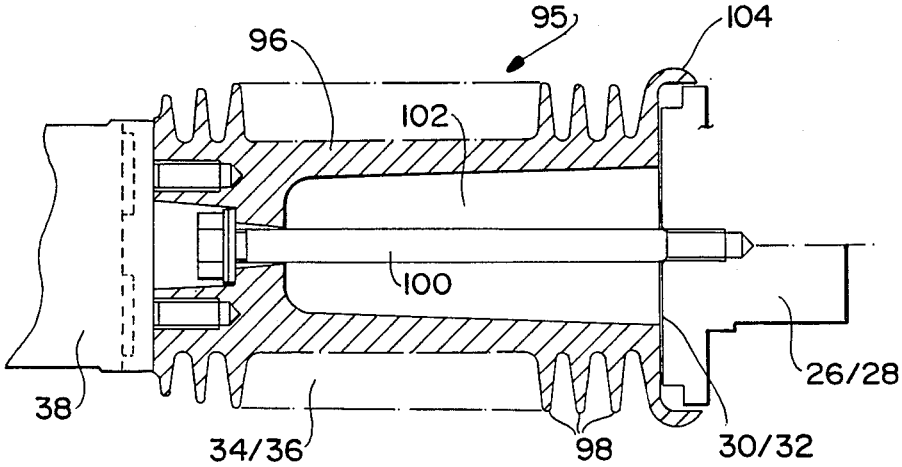
Fig. 6

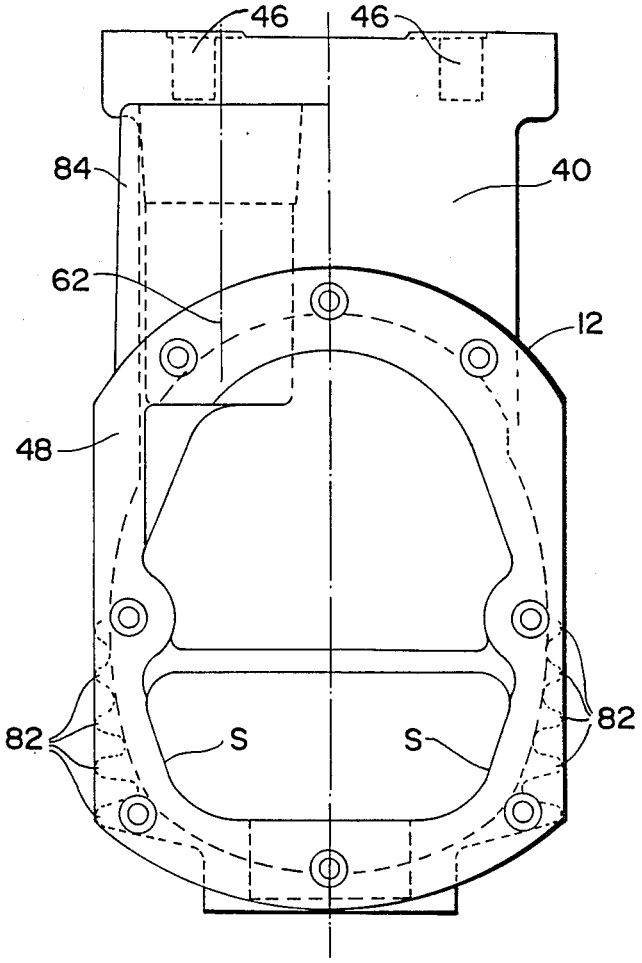
Fig. 7
Fig. 8
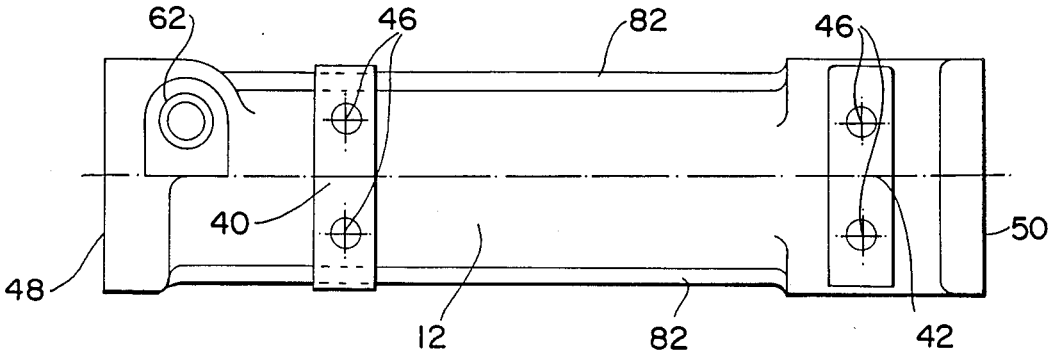

ELECTRICAL CIRCUIT BREAKER WITH IMPROVED DIELECTRIC WITHSTAND

BACKGROUND OF THE INVENTION

The invention relates to an electrical circuit breaker having a sealed casing made of moulded insulating material, filled with an insulating gas with high dielectric strength, notably sulphur hexafluoride, and comprising:

a system of separable contacts actuated by means of an operating mechanism, a pair of connection terminals in electrical connection with said contacts via bushings of conducting material, passing through the wall of the lateral surface of the casing and extending perpendicular to the longitudinal axis, and means of fixing the insulating casing to a metal support electrically connected to the ground or earth.

A puffer circuit breaker of the kind mentioned is described in French Pat. No. 2,441,916 filed by the applicant. The circuit breaker comprises a main circuit having a fixed main contact operating in conjunction with a movable main contact, and an auxiliary shunting circuit having a fixed arcing contact and a movable arcing contact. Inside the oblong casing, the main circuit is connected directly to the connection terminals extending along a trajectory directly adjacent and shorter than that of the auxiliary circuit. Opposite from the connection terminals, the circuit breaker is equipped with fixing studs cast with the insulating casing, and comprising inserts to receive screws when the circuit breaker is secured to the metal support at ground potential. The external lateral surface of the casing is smooth, which gives rise to a problem of electrical insulation and dielectric withstand of the circuit breaker in the presence of a high rated voltage, for example greater than 20 kV. It is then imperative that the dimensions of the casing be increased to adapt the distance in the air to the minimum value laid down by standards. Modifying the casing gives rise to an increase in dimensions and in the cost of manufacturing the circuit breaker.

The object of the invention consists in increasing the electrical insulation of a puffer circuit breaker without increasing the internal dimensions of the casing filled with insulating gas of high dielectric strength.

SUMMARY OF THE INVENTION

The circuit breaker according to the invention is characterized by the fact that the external lateral surface of the insulating casing comprises a plurality of flanges designed to increase the creepage distance between the terminals and the support, the value of the creepage distance being greater than the distance in the air between the same parts, and the internal lateral surface in contact with the insulating gas of the casing is smooth at the level of the external flanges.

The flanges are advantageously cast with the insulating casing and extend over the whole length of the lateral surface in a parallel direction to the longitudinal axis.

According to another feature of the invention, the casing is provided with an annular rib protruding out at the level of an orifice arranged in the wall of the casing for the metal transmission shaft coupled to the external operating mechanism to pass through. The presence of the rib around the shaft increases the creepage distance between the nearest connection terminal and the shaft at ground potential.

In the withdrawable version of the circuit breaker, the connection terminals can receive current connectors each comprising a draw-in arm having a first end rigidly secured to each connection terminal, and a second opposite end bearing a draw-in contact grip, the draw-in arm being shaped as a heat sink comprising a metal body equipped with cooling flanges on its external face. The first end of the draw-in arm comprises a curved revolution cover designed to cover the protruding edges of the corresponding connection terminal.

BRIEF DESCRIPTION OF THE DRAWINGS

Other advantages and characteristics will become more clearly apparent from the followng description of an embodiment of the invention, given as a non-limiting example only, and represented in the accompanying drawings, in which:

FIG. 3 is a detailed view of the connection system of the fixed main contact in FIG. 2;

FIG. 4 is a side view of FIG. 3;

FIG. 5 is a cross-sectional view along the line V—V in FIG. 4;

FIG. 6 represents a cross-sectional view of an alternative embodiment of the draw-in arm according to FIG. 1;

FIG. 7 is a bottom view, on an enlarged scale, of the insulating casing of the circuit breaker according to FIG. 2, after the active parts and the operating mechanism have been removed; and FIG. 8 is a side view of the insulating casing.

DESCRIPTION OF THE PREFERRED EMBODIMENT

Figure 2:
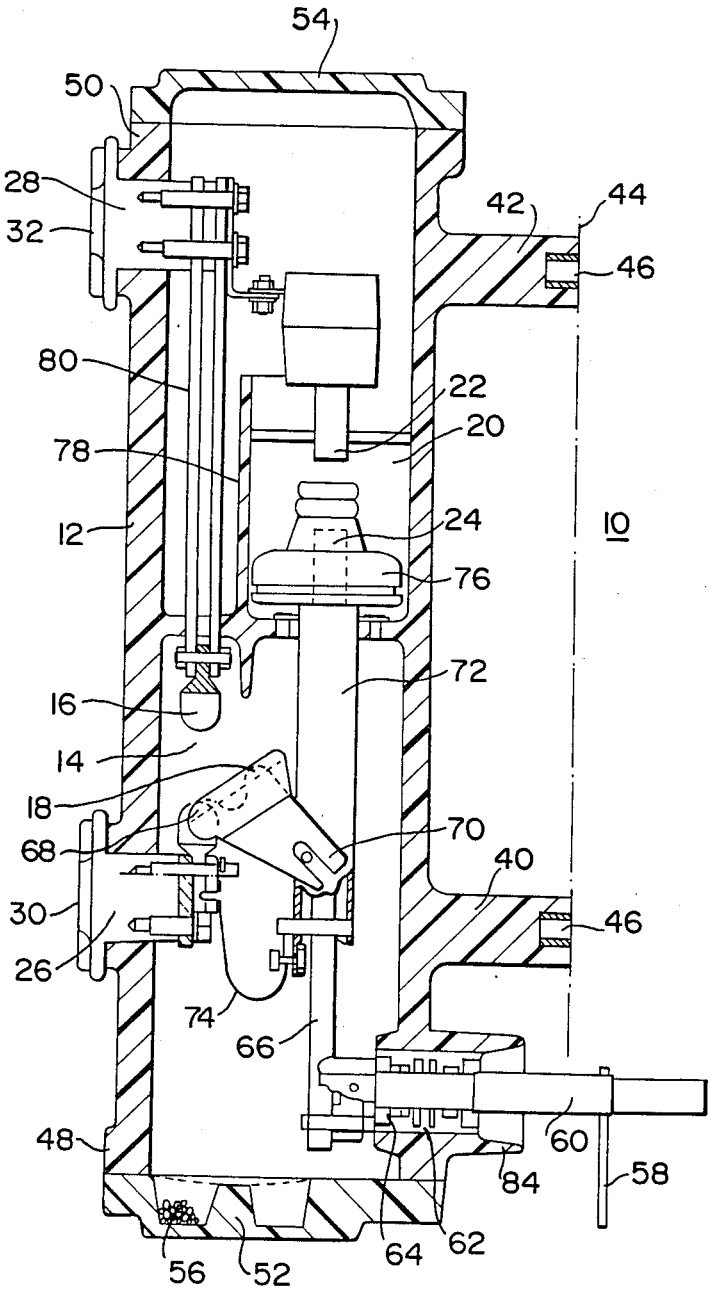
FIG. 2 shows, on an enlarged scale, an axial sectional view of a non-withdrawable circuit breaker according to the invention.

In the figures, a pole of a puffer electrical circuit breaker 10 is housed in a sealed casing 12 of moulded insulating material, filled with an electronegative insulating gas of high dielectric strength, notably sulphur hexafluoride. The oblong casing 12 made of epoxy resin houses a main circuit 14 for the rated current to flow through having a pair of main contacts 16, 18, one 18 of which is movable, and an auxiliary shunting circuit 20 of the main circuit 14 having a pair of arcing contacts 22, 24, one of which is movable (in dotted line in FIG. 2). A pair of bushings 26, 28 offset in relation to one another in the longitudinal direction pass radially through the wall of the casing 12 to constitute an input terminal 30 and an output terminal 32 of the circuit breaker pole 10.

In the draw-out version of the circuit breaker 10 (FIG. 1), each connection terminal 30, 32 is equipped with a current connector 34, 36 formed by a draw-in arm of a contact grip 38. The circuit breaker 10 is mounted on a movable carriage 37, fitted with roller parts 39 allowing translational movement of the circuit breaker 10 between the drawn-in and drawn-out positions.

In the fixed version of the circuit breaker 10 (FIG. 2), electrical connection of the pole is achieved directly on the external terminals 30, 32 of the conducting bushings 26, 28, in the absence of the current connector draw-in arms 34, 36.

Figure 1:
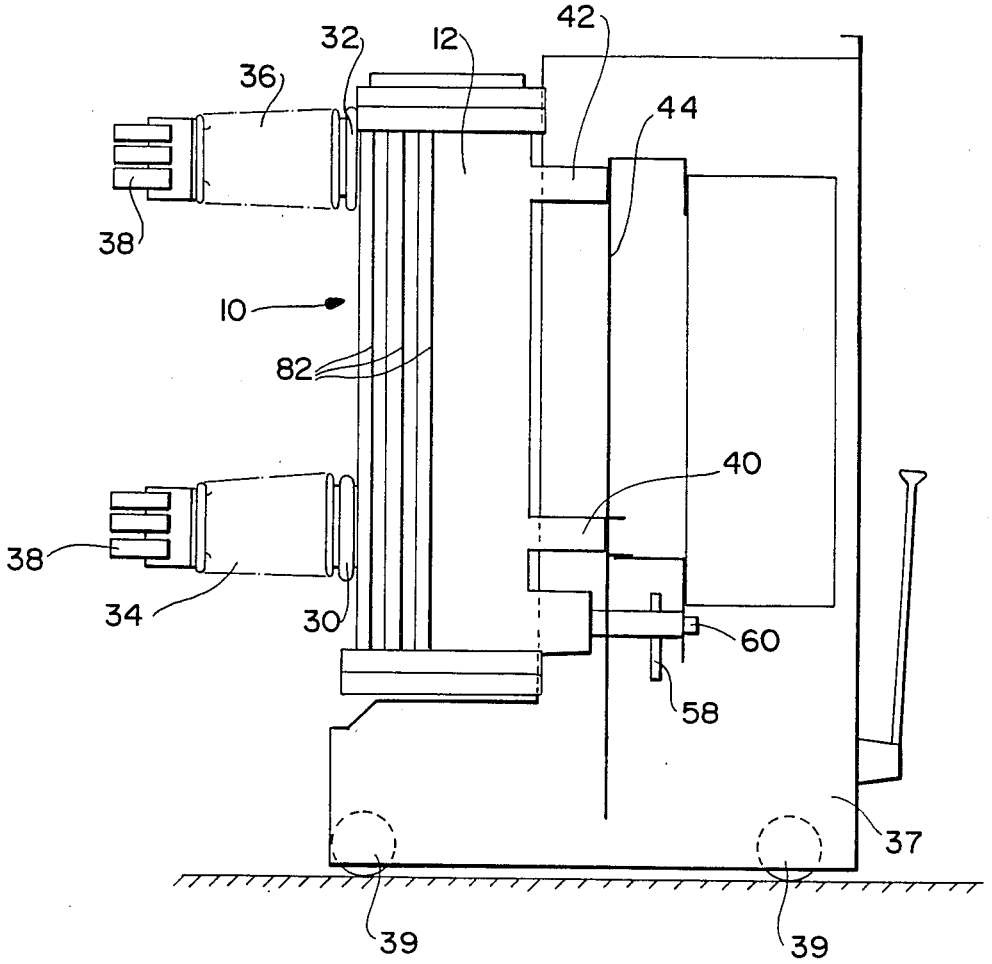
FIG. 1 is a schematic elevational view of a withdrawable circuit breaker according to the invention, the circuit breaker being mounted on a movable carriage.

Opposite the terminals 30, 32, the side wall of the insulating casing 12 comprises a pair of fixing studs 40, 42 designed to mechanically secure the circuit breaker 10 to an electrically grounded metal support 44. The circuit breaker support 44 may form a part of a fixed frame (FIG. 2) or be installed on the movable carriage 37 (FIG. 1). The studs 40, 42 are cast with the insulating casing 12, in such a way as to protrude out from the side wall situated opposite the bushings 26, 28. Metal inserts 46 sunk into the end of each insulating stud 40, 42 can accommodate fixing screws (not shown) when the circuit breaker 10 is secured to the support 44.

The opposing open ends 48, 50 of the casing 12 are respectively blanked off by means of a lower cover 52 and an upper cover 54. A molecular sieve 56 is housed inside the casing 12 in a cavity of the lower cover 52.

An external operating mechanism (not shown) is mechanically coupled to a crank-handle 58 keyed onto a rotary shaft 60 passing through an orifice 62 of the casing 12 with a dynamic sealing system 64 interposed. Inside the casing 12, the shaft 60 is articulated on an insulating transmission rod 66 designed to drive the moving assembly of the circuit breaker pole 10. The orifice 62 through which the rotary shaft 60 passes is located between the fixing stud 40 and the lower end 48 of the casing 12.

The movable main contact 18 of the main circuit 14 is pivotally mounted on a fixed spindle 68 supported by the lower bushing 26. An intermediate transmission system 70 mechanically connects the movable main contact 18 to an operating rod 72 movable in translation having an end articulated on the insulating transmission rod 66, and an opposite end supporting the movable arcing contact 24. The rod 72 is conducting, and is electrically connected to the lower bushing 26 by a flexible link conductor 74. When the shaft 60 rotates, the transmission system 70 transforms the straight-line movement of the rod 72 into a pivoting movement of the movable main contact 18, the assembly being arranged to cause separation of the main contacts 16, 18 before separation of the arcing contacts 22, 24. The pivoting movement of the movable main contact 18 is thus derived from the sliding movement of the operating rod 72 of the movable arcing contact 24.

A piston 76 and gas compression cylinder 78 puffer device is associated with the pair of arcing contacts 22, 24, and is actuated when the operating rod 72 moves to cause the arc drawn when the arcing contacts 22, 24 separate to be blown out pneumatically.

The fixed main contact 16 is supported by a fixed connection system electrically connected to the upper bushing 28. The fixed arcing contact 22 is also connected to the upper bushing 28. Inside the casing 12, the main circuit 14 is connected directly to the bushings 26, 28 extending along a longitudinal trajectory directly adjacent and shorter than that of the transversely offset auxiliary circuit 20.

Operation of a circuit breaker of this kind is well-known to those skilled in the art, and is described in detail in French Pat. No. 2,441,916 filed by the applicant.

According to the invention, the external lateral surface of the insulating casing 12 comprises a plurality of longitudinal flanges 82 designed to increase the creepage distance between the conducting terminals 30, 32 and the ground of the metal support 44, constituting two active parts of different polarities. The creepage distance corresponds to the shortest distance between these parts at the surface of the insulating material of the casing 12 and of the fixing studs 40, 42. The creepage distance value is greater than the distance in the air between the same parts. The flanges 82 are formed by external longitudinal ribs obtained from casting with the casing 12, and extending over the whole length between the ends 48, 50 of the casing 12 in a parallel direction to the longitudinal axis (see FIGS. 1 and 8). The internal wall of the lateral revolution surface of the casing 12 is smooth (designated by "S" in FIG. 7) whereas the external flanges 82 are advantageously located at regular intervals on both sides of each terminal 30, 32 on a fraction of the external wall of the casing 12 (see FIG. 7). The remainder of the wall between the flanges 82 and the fixing studs 40, 42 is smooth.

The casing 12 is provided with an additional rib 84 at the level of the orifice 62 through which the rotary shaft 60 passes, the latter being made of metallic material and connected to the ground potential. The rib 84 has an annular external edge which increases the creepage distance between the lower terminal 30 and the operating shaft 60. The edge is set back in relation to the insulating stud 40.

The presence of the longitudinal flanges 82 and of the annular rib 84 on the external surface improves the dielectric withstand (i.e., the maximum ability of insulating materials and spacings to withstand nominal voltages and specified overvoltages without flashover or breakdowns) and the electrical insulation of the circuit breaker without increasing the internal dimensions of the casing 12. The rated voltage of the circuit breaker can thus be increased from 18 kV to 24 kV. The flanges 84 also contribute to cooling the insulating gas when breaking takes place.

It can be seen in the middle zone of the casing 12 that the connection system 80 of the fixed main contact 16 is at the potential of the upper terminal 18, whereas the movable arcing contact 24 and the conducting rod 72 are at the potential of the lower terminal 30. This difference in potential generates a large electrical field in this zone. To avoid possible internal flashover, the connection system 80 comprises two parallel flat copper bars 86, 88 (FIGS. 3 to 5), each having a rectangular cross-section with rounded edges 90. The fixed main contact 16 is provided with a tail-part 92 acting as a spacer sandwiched between the two offset bars 86, 88. Fixing screws 94 secure the fixed main contact 16 to the two bars 86, 88 of the connection system 80. The presence of the rounded edges 90 on the bars 86, 88, and of the intermediate wall of the cylinder 78 prevents any internal flashover occurring.

In FIG. 6, the draw-in arm of each current connector 34, 36 of a withdrawable circuit breaker is arranged as a heat sink 95 having a metal body 96 presenting on its external face a series of cooling flanges 98. The annular flanges 98 are cast with the body 96 and provide a good heat evacuation when the current flows through. The body 96 is rigidly secured to the connection terminal 30, 32 of the corresponding bushing 26, 28 by means of a fixing gudgeon 100 extending through the hollow internal part 102 of the body 96. The heat sink 95 is equipped at one of its ends with a curved revolution cover 104 which covers the protruding edges of the connection terminal 30, 32. The other end of the heat sink 95 acts a support for the draw-in contact grip 38. The presence of the cover 104 as an integral part of the flanges 98 of the heat sink 95 improves the dielectric withstand of the circuit breaker.

The invention has been described as being applied to an air-blow circuit breaker with a piston and insulating gas compression cylinder system, but it can be extended to any other type of circuit breaker, notably with self-expansion and/or magnetic blow-out by arc rotation by means of a permanent magnet or a coil.

I claim:

1. An electrical circuit breaker having a sealed casing made of molded insulating material, filled with an insulating gas with high dielectric strength, notably sulphur hexaflouride, and comprising:

an operating mechanism for actuating a system of separable contacts between closed and open positions, a pair of connection terminals in electrical connection with said contacts via bushings of conducting material, said terminals passing through the wall of the lateral surface of the casing and extending perpendicular to the longitudinal axis, fixing means for mounting the insulating casing to a metal support electrically connected to the ground or earth, a plurality of flanges provided on the external lateral surface of the casing to increase the creepage distance between the terminals and the support, the value of the creepage distance being greater than the distance in the air between the same parts, said casing having a smooth internal lateral surface in contact with the insulating gas and extending on an opposite side of the external flanges.

2. An electrical circuit breaker according to claim 1, wherein the flanges are cast with the insulating casing and extend over the whole length of the external lateral surface in a parallel direction to the longitudinal axis.

3. An electrical circuit breaker according to claim 1, wherein the flanges are located on both sides of each terminal at regular intervals over a fraction of the external lateral surface of the casing.

4. An electrical circuit breaker according to claim 1, having:

an orifice arranged in the casing for the metal transmission shaft of the operating mechanism to pass through via a sealing device, and an annular rib being a part of the casing and protruding outwards at the level of the orifice in such a way as to increase the creepage distance between the nearest connection terminal and the shaft at ground potential.

5. An electrical circuit breaker according to claim 4, wherein the fixing means for mounting the circuit breaker to the metal support are formed by insulating studs cast with the casing and protruding out from the lateral wall situated opposite the corresponding connection terminals, each stud extending perpendicular to the longitudinal axis of the casing.

6. An electrical circuit breaker according to claim 5, wherein the annular rib coaxially surrounds the shaft, and is arranged set back from the nearest fixing stud.

7. An electrical circuit breaker according to claim 1, wherein the system of separable contacts comprises:

a main circuit for the noted current to flow through having a pair of fixed and movable main contacts, an auxiliary shunting circuit having a pair of fixed and movable arcing contacts, the fixed main contact and the fixed arcing contact being electrically connected to one of the connection terminals, whereas the movable main contact and the movable arcing contact are connected to the other connection terminal of the pole, a connection system between the fixed main contact and the associated connection terminal, having at least two conducting bars extending parallel to the longitudinal axis of the casing, each bar presenting a rectangular cross-section with rounded edges, the fixed main contact being provided with a tailpart acting as a spacer between the two offset bars.

8. An electrical circuit breaker according to claim 1, comprising:

a current connector including a draw-in arm having a first end rigidly secured to each connection terminal, and a second opposite end bearing a draw-in contact grip, the draw-in arm being shaped as a heat sink comprising a metal body equipped with cooling ribs on its external face, and a curved revolution cover arranged on the first end of the draw-in arm to cover the protruding edges of the corresponding connection terminal.

9. An electrical circuit breaker according to claim 8, wherein cover and the cooling ribs are cast with the metal body of the heat sink.

* * * * *